US011742166B2

(12) United States Patent
Hoffmann et al.

(10) Patent No.: US 11,742,166 B2
(45) Date of Patent: Aug. 29, 2023

(54) SWITCHING DEVICE FOR SWITCHING AN ELECTRICAL LOAD

(71) Applicant: TDK Electronics AG, Munich (DE)

(72) Inventors: Robert Hoffmann, Berlin (DE); Jonas Weinhardt, Berlin (DE)

(73) Assignee: TDK Electronics AG, Munich (DE)

( * ) Notice: Subject to any disclaimer, the term of this patent is extended or adjusted under 35 U.S.C. 154(b) by 43 days.

(21) Appl. No.: 16/968,431

(22) PCT Filed: Feb. 6, 2019

(86) PCT No.: PCT/EP2019/052905
§ 371 (c)(1),
(2) Date: Aug. 7, 2020

(87) PCT Pub. No.: WO2019/154855
PCT Pub. Date: Aug. 15, 2019

(65) Prior Publication Data

US 2020/0402753 A1 Dec. 24, 2020

(30) Foreign Application Priority Data

Feb. 7, 2018 (DE) ..... 102018102736.2

(51) Int. Cl.
*H01H 3/00* (2006.01)
*H01H 50/54* (2006.01)
(Continued)

(52) U.S. Cl.
CPC ..... *H01H 50/546* (2013.01); *H01H 50/18* (2013.01); *H01H 50/36* (2013.01)

(58) Field of Classification Search
CPC ..... H01H 50/546; H01H 50/18; H01H 50/36; H01H 50/34
(Continued)

(56) References Cited

U.S. PATENT DOCUMENTS 2,839,631 A * 6/1958 Rice ..... H01H 51/30 335/200
2,929,899 A * 3/1960 Filliette ..... H01H 50/22 335/203
(Continued)

FOREIGN PATENT DOCUMENTS

CN 1181605 A 5/1998
CN 101677044 A 3/2010
(Continued)

*Primary Examiner* — Shawki S Ismail
*Assistant Examiner* — Lisa N Homza
(74) *Attorney, Agent, or Firm* — Slater Matsil, LLP

(57) ABSTRACT

In an embodiment a switching device includes a first fixed contact element, a second fixed contact element, a movable contact bridge, a movable shaft configured to move the contact bridge, wherein the contact bridge is arranged at an end of the shaft, wherein the shaft is movable to a first position at which the contact bridge contacts the first and second contact elements, and wherein the shaft is movable to a second position at which the contact bridge is arranged at a distance from the first and second contact elements and a setting device configured to set the distance between the contact bridge and the first and second contact elements in the second position, wherein the setting device is arranged at the end of the shaft, and wherein the switching device is configured to switch an electrical load.

17 Claims, 5 Drawing Sheets

(51) Int. Cl.
*H01H 50/18* (2006.01)
*H01H 50/36* (2006.01)

(58) Field of Classification Search
USPC ..... 335/185
See application file for complete search history.

(56) References Cited

U.S. PATENT DOCUMENTS 3,189,705 A * 6/1965 Geusendam ..... H01H 51/065 200/243
3,388,353 A * 6/1968 Isler ..... H01H 11/0012 335/132
3,571,770 A * 3/1971 Dew ..... H01H 51/065 439/675
3,781,727 A * 12/1973 Pollmann ..... H01H 50/22 335/132
3,964,006 A * 6/1976 Lacan ..... H01H 50/22 335/132
4,345,224 A * 8/1982 Lenzing ..... H01H 1/2008 29/602.1
4,371,855 A * 2/1983 Lenzing ..... H01H 50/22 29/602.1
4,431,978 A * 2/1984 Lenzing ..... H01H 51/06 335/282
4,523,165 A * 6/1985 Schedele ..... H01H 9/40 335/133
4,604,597 A * 8/1986 Bogner ..... H01H 3/001 335/131
4,706,037 A * 11/1987 Prouty ..... H01F 7/12 335/277
4,755,781 A * 7/1988 Bogner ..... H01H 51/065 335/131
4,987,396 A * 1/1991 Bogner ..... H01H 1/2083 335/131
5,159,908 A * 11/1992 Eyermann ..... F02N 15/003 290/38 R
5,214,401 A * 5/1993 Kimura ..... H01H 3/001 335/131
5,394,128 A * 2/1995 Perreira ..... H01H 51/06 335/154
5,481,236 A * 1/1996 Ruehle ..... H01H 51/065 335/131
5,742,015 A 4/1998 Moldovan et al.
5,880,658 A * 3/1999 Donhauser ..... H01H 89/06 218/155
5,892,194 A * 4/1999 Uotome ..... H01H 51/065 335/154
6,236,293 B1 * 5/2001 Forster ..... H01H 51/2209 335/132
6,377,143 B1 * 4/2002 Zhou ..... H01H 50/546 218/154
6,943,654 B2 * 9/2005 Zhou ..... H01H 50/546 335/106
6,967,549 B2 * 11/2005 Zhou ..... H01H 9/563 335/106
7,504,916 B2 * 3/2009 Masaki ..... H01H 50/30 335/277
7,772,944 B2 * 8/2010 Kurasawa ..... F02N 11/00 335/131
8,125,303 B2 * 2/2012 Klingel ..... F02N 15/00 335/131
8,138,440 B2 * 3/2012 Onufriyenko ..... H01H 73/045 335/193
8,786,388 B2 * 7/2014 Ramezanian ..... H01H 51/065 335/133
9,368,266 B2 * 6/2016 Mailer ..... H01F 7/1607
9,728,360 B2 8/2017 Birner et al.
2006/0125581 A1 * 6/2006 Ohkubo ..... H01H 50/34 335/132
2007/0069840 A1 * 3/2007 Masaki ..... H01H 50/30 335/126
2008/0024253 A1 * 1/2008 Kurasawa ..... F02N 15/067 335/196
2012/0098629 A1 * 4/2012 Weigt ..... F02N 15/006 335/126
2012/0105179 A1 * 5/2012 Kurasawa ..... H01H 51/065 335/185
2012/0212781 A1 * 8/2012 Kohata ..... G06F 3/1285 358/1.15
2015/0042426 A1 * 2/2015 Ignatov ..... H01H 3/28 335/193
2016/0020010 A1 * 1/2016 Mailer ..... F02N 11/087 29/602.1
2019/0148095 A1 * 5/2019 Minowa ..... H01H 50/42 335/185

FOREIGN PATENT DOCUMENTS

CN 104966646 A 10/2015
CN 105513897 A 4/2016
CN 106067406 A 11/2016
CN 205723359 U 11/2016
CN 106992100 A 7/2017
EP 3258476 A1 12/2017

* cited by examiner

SWITCHING DEVICE FOR SWITCHING AN ELECTRICAL LOAD

This patent application is a national phase filing under section 371 of PCT/EP2019/052905, filed Feb. 6, 2019, which claims the priority of German patent application 102018102736.2, filed Feb. 7, 2018, each of which is incorporated herein by reference in its entirety.

TECHNICAL FIELD

The invention relates to a switching device for switching an electrical load, for example to a contactor or relay for isolating battery circuits.

BACKGROUND

A switching device for switching an electrical load can take the form of a power contactor. Power contactors are electrically operated, remotely actuated switches. Such switching devices have a control circuit which can switch a load circuit on and off.

One possible application for power contactors is the opening and isolation of battery circuits in motor vehicles, for example in hybrid electric motor vehicles (HEV), plug-in hybrid motor vehicles (PHEV), battery electric vehicles (BEV), etc. It is customary here for both the plus and the minus contact of the battery to be isolated by a power contactor. The disconnection of the contact occurs in the inoperative state of the vehicle and also in the case of a disturbance, for example in the event of an accident. The main function of the switching device or of the power contactor is to switch the vehicle to zero voltage and to interrupt the current flow. For this purpose, contacts in the contactor are mechanically isolated from one another. In order to achieve secure isolation of the contacts, it is desirable that the contacts have a certain minimum spacing in the isolated state.

SUMMARY

Embodiments provide a switching device for switching an electrical load in which there is a possibility for adapting a contact spacing between a movable contact bridge and fixed contact elements of the switching device in order, for instance, to overcome incorrect spacings which occur, for example, as a result of manufacturing and assembly tolerances.

According to one possible embodiment, the switching device comprises a first fixed contact element, a second fixed contact element and a movable contact bridge. Furthermore, the switching device has a movable shaft or rod for moving the contact bridge, wherein the contact bridge is arranged at an end of the shaft. The shaft can be moved to a first position at which the contact bridge contacts the first and second contact element. Moreover, the shaft can be moved to a second position at which the contact bridge is arranged at a distance from the first and second contact element. The switching device further comprises a setting device for setting the distance between the contact bridge and the first and second contact element in the second position. The setting device is arranged at the end of the shaft.

The end of the movable shaft at which the contact bridge and the setting device are arranged is the upper end of the shaft. The opposite, lower end of the movable shaft is fixed to an armature of the switching device. When the armature moves as a result of a magnetic action of force, the movable shaft and thus also the contact bridge are moved.

According to a further embodiment of the switching device, the setting device can be embodied as a nut, in particular as an adjusting nut, which is arranged at the upper end of the movable shaft. It is possible by means of this nut for the distance between the contact bridge and the fixed contact elements to be set directly. At the upper end of the shaft, which is close to the two fixed contact elements, that is to say the main contacts, the shaft can have a thread. The nut is screwed onto the thread. The distance of the contact bridge from the fixed contact elements can be set by adapting the screwing-in depth of the nut.

According to a further embodiment, the setting device has a setting element which bears with a bearing part, in particular with an underside of the bearing part, on an upper side of the contact bridge and which projects with a cylinder part at least partially into the hole and preferably projects through the hole. For example, the setting element can have an internal thread with which the setting element is screwed on a thread of the shaft. The internal thread can be arranged in particular in the cylinder part. The distance of the contact bridge from the fixed contact elements can be set by adapting the screwing-in depth of the setting element. With particular preference, the setting element can comprise an electrically insulating material.

The switching device can have a contact spring for exerting a force on an underside of the contact bridge. At the first position of the movable shaft, an upper side of the contact bridge bears on the first and second fixed contact element. For example, when screwing the nut into the thread or when screwing the setting element onto the thread of the shaft, the contact bridge is moved downwardly away from the fixed contact elements such that the distance between the fixed contact elements and the contact bridge increases. Here, the contact spring is compressed and generates a counterforce. Stepless setting of the bridge position, that is to say stepless setting of the distance of the contact bridge from the fixed contact elements, is possible through the action of force of the contact spring on the underside of the contact bridge in dependence on a screwing-in depth of the nut or of the setting element on the thread.

The setting device can be locked with the movable shaft in order to lock the distance of the contact bridge from the fixed contact elements. The setting device can be fixed for example at the upper end of the movable shaft with the shaft by means of a nut in the form of a locknut after the adjustment. As an alternative thereto, the setting device can for example also be adhesively bonded or welded to the shaft at the upper end of the movable shaft after the adjustment.

BRIEF DESCRIPTION OF THE DRAWINGS

The invention will be explained in more detail below on the basis of figures which show exemplary embodiments of the switching device for switching an electrical load.

In the figures.

DETAILED DESCRIPTION OF ILLUSTRATIVE EMBODIMENTS

Figure 1:
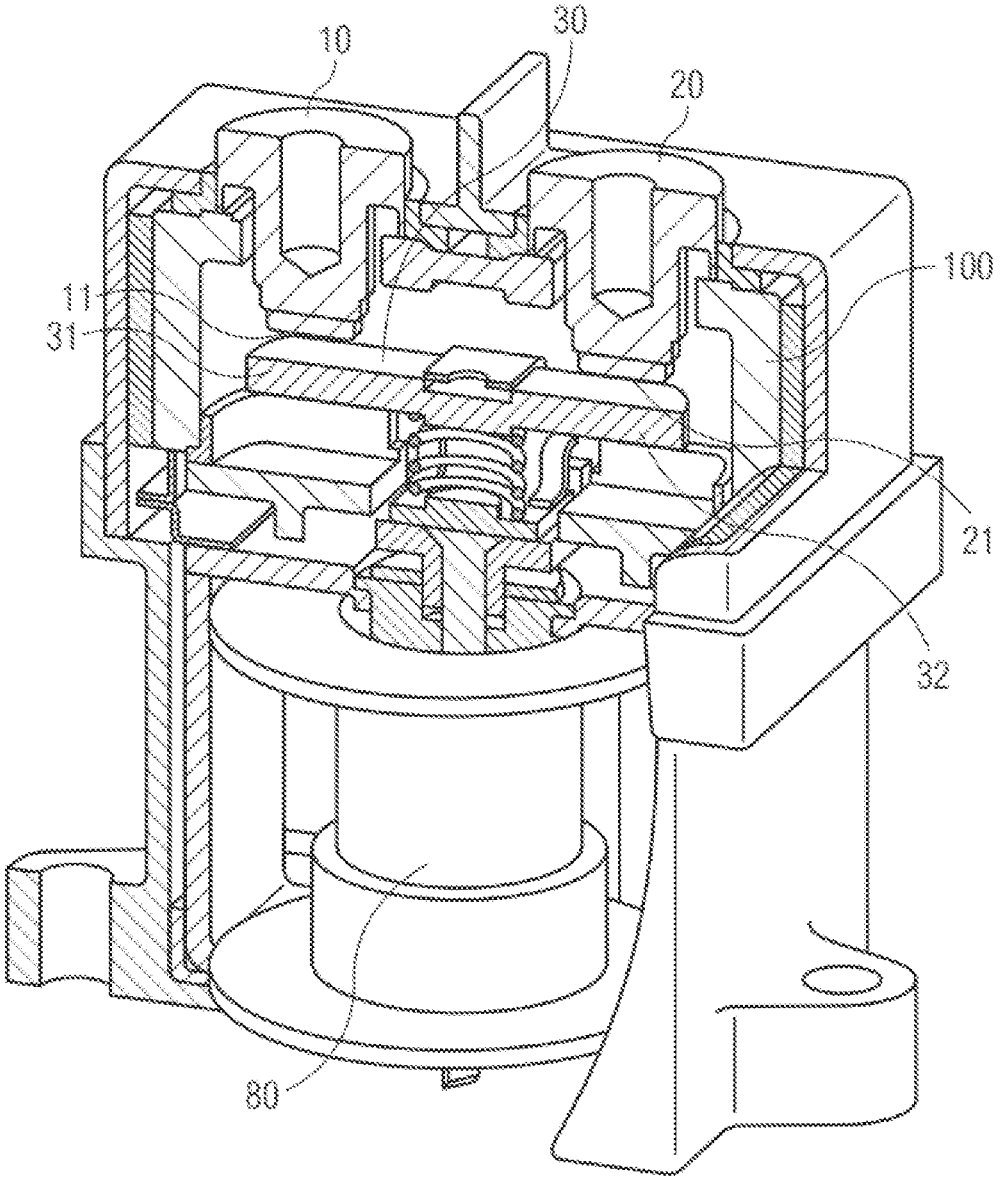
FIG. 1 shows a schematic illustration of an example of a switching device for switching an electrical load.

FIG. 1 shows in a sectional illustration an example of a switching device in the form of a contactor for switching an electrical load. The switching device comprises a switching chamber 100 having a fixed contact element 10 and a fixed contact element 20 which project as outer main contacts into the switching chamber 100. In the switching chamber 100 there is situated a movable contact bridge 30 which, as closing element, can conductively connect inner contacts 11, 21 of the contact elements 10 and 20. For this purpose, the contact bridge can be raised upwardly in the direction of the fixed contact elements 10, 20 by means of a magnetic drive 80, which is indicated in FIG. 1 in the lower region of the switching device corresponding to the depicted illustration, until the inner contacts 11, 21 of the contact elements 10, 20 contact the contact bridge 30, in particular edge regions 31, 32 thereof, and thus are short-circuited via the contact bridge 30.

To interrupt the current flow, a shaft 40, which is substantially embodied in the form of a rod and to which the movable contact bridge 30 is fastened, is moved downwardly by spring forces of a return spring (not shown) and electrically isolated from the contact elements 10, 20, with the result that the two fixed contact elements 10, 20 are no longer conductively connected via the contact bridge 30, with the result that the switching device is in an open switching state.

It is possible in particular for the switching device, in the form of the depicted contactor for isolating battery circuits in motor vehicles, to be gas-filled and thus hermetically sealed with respect to the surroundings. Closing and opening of the contact bridge 30 can give rise to switching sparks, the extinguishing thereof is influenced inter alia by the distance of the inner contacts 11, 21 of the contact elements 10, 20 from the contact bridge 30 in the open state of the contactor.

In addition, different standards, for example IEC 60664 1, place requirements on minimum spacings between the inner contacts 11, 21 of the contact elements 10, 20 and the contact bridge 30. It is therefore absolutely necessary that the distance between the fixed contact elements 10, 20 on the one hand and the contact bridge 30 on the other hand have a defined, controllable value. However, as a result of manufacturing and component tolerances, this distance value can be set poorly in switching devices which are customary in the prior art.

One possibility of controlling the distance between the movable contact bridge 30 and the fixed contact elements 10, 20 is X-ray testing on the finished component. However, it is a disadvantage here in the case of customary contactors in the prior art that subsequent adjustment of the distance between the movable contact bridge and the fixed contact elements is no longer possible if it is determined that the distance between the contact bridge and the contact elements does not correspond to the requirements.

The following figures show exemplary embodiments for a switching device 1 which is provided and suitable for switching an electrical load and in which a distance between fixed contact elements 10, 20 of the switching device 1 and a movable contact bridge 30 of the switching device 1, in particular between inner contacts 11, 21 of the contact elements 10, 20 and edge regions 31, 32 of the movable contact bridge 30, can be set.

The switching device 1 can be embodied as a relay or as a contactor, in particular a power contactor. The switching device 1 comprises a control circuit which can switch a load circuit on and off. By means of the depicted switching device, it is possible for example to open and isolate battery circuits in motor vehicles, in particular in the hybrid electrical vehicles, plug-in hybrid vehicles or battery electric vehicles mentioned at the outset. In the aforementioned application case it is possible for both the plus and the minus contact of a vehicle battery to be isolated by means of the switching device 1.

Figure 2:
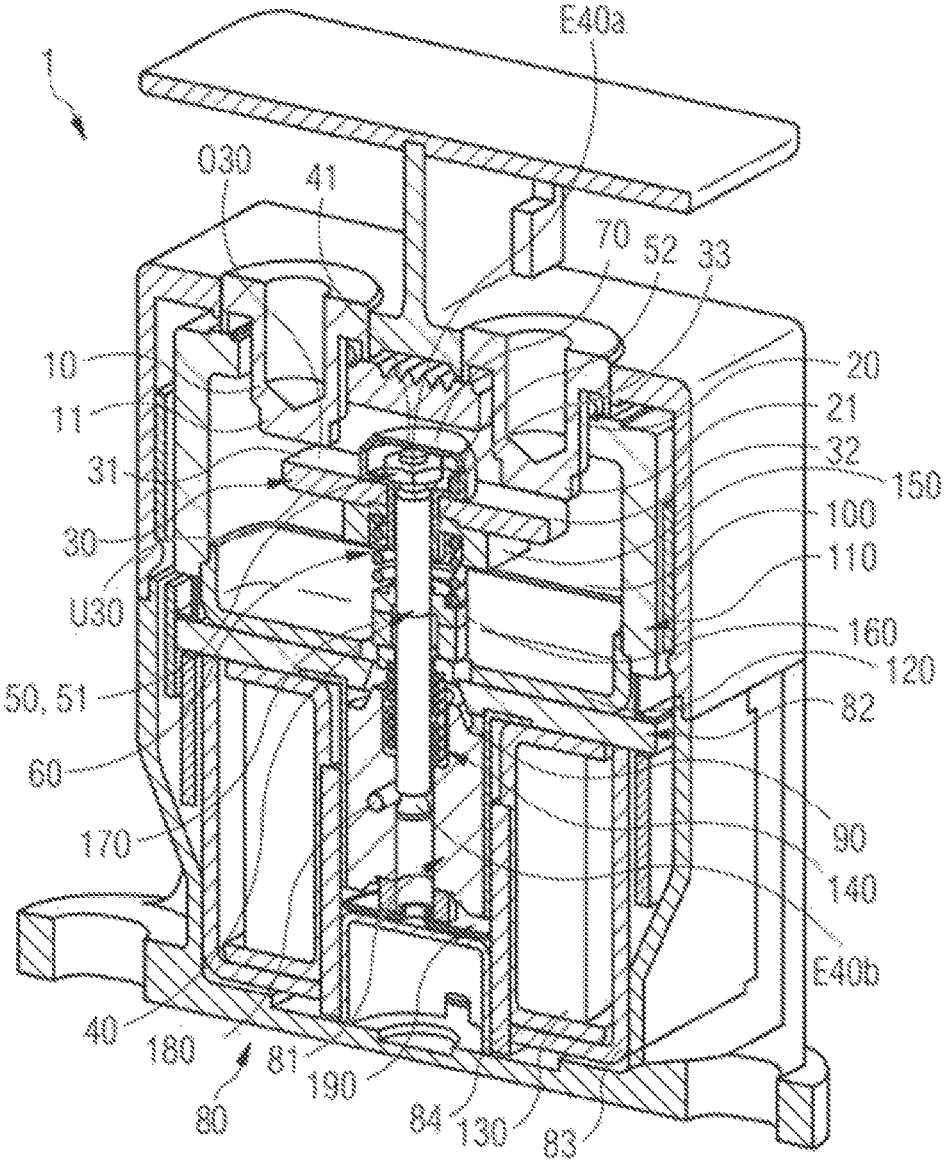
FIG. 2 shows a schematic illustration of a switching device for switching an electrical load according to one exemplary embodiment.

FIG. 2 shows an exemplary embodiment for the switching device 1 which, in addition to the fixed contact element 10, the fixed contact element 20 and the movable contact bridge 30, has a movable shaft 40, substantially in the form of a rod, for moving the contact bridge 30. The contact bridge 30 is arranged at an upper end E40*a* of the movable shaft 40. The shaft 40 can be moved to a first position at which the movable contact bridge 30 contacts the first and second fixed contact element 10, 20. Furthermore, the shaft 40 can be moved to a second position at which the contact bridge 30 is arranged at a distance from the first and second fixed contact element 10, 20. The movable contact bridge 30 does not contact the fixed contact elements 10 and 20 at the second position of the shaft.

The switching device 1 comprises a magnetic drive 80 which is embodied to move the contact bridge 30 between the first and second position. The magnetic drive 80 has an armature 81 and also a yoke 82. An upper side O30 of the contact bridge 30 bears at the first position of the shaft 40 on the first and second contact element 10 and 20.

The magnetic drive 80 further comprises a metallic wall 83 and a metallic wall 84 for closing the magnetic circuit. In a space between the yoke 82 and the metallic walls 83, 84 there is arranged a coil body 130 with a wire winding for carrying a current. The movable shaft 40 is fixedly connected at a lower end E40*b* to the armature 81. For this purpose, a pin 180 can engage in a groove at the lower end E40*b* of the shaft 40.

The fixed contact elements 10, 20 and the movable contact bridge 30 are arranged in a switching chamber 100 of the switching device 1. The switching chamber 100 is surrounded by a wall 110 and a cover 120. A return spring 140 is arranged in a region between an underside of the cover 120 and a recess in the armature 81. The upper end of the return spring 140 is supported on the underside of the cover 120. A lower end of the return spring 140 is supported on a bottom side of the recess of the armature 81.

The switching device 1 comprises a contact spring 60 for exerting a force on an underside U30 of the contact bridge 30. Between the contact spring 60 and the underside U30 of the contact bridge 30 there can be provided a bearing element 150. The bearing element 150 bears at an upper end of the contact spring 60 on the contact spring 60. The contact spring 60 is supported with a lower end on a further bearing element 160. The lower bearing element 160 bears on a buffer element 170, for example a rubber buffer, which is arranged on the cover 120.

The contact spring 60 can be embodied as an overstroke spring. The spring forces of the return spring 140 and of the overstroke spring 60 are tailored to one another in such a way that the movable shaft 40 which bears the movable contact bridge 30 is arranged at the second position at which the movable contact bridge 30 does not connect the contact elements 10, 20 if no flow flows in the windings of the coil body 130 and thus no magnetic flux is induced in the magnetic drive 80. In the de-energized state of the magnetic drive 80, the switching device 1 is thus in an open, nonconducting position.

If, by contrast, an electric current is generated in the winding of the coil body 130 by applying a voltage, a magnetic field which exerts a force on the movable shaft 40 is induced in the magnetic drive 80. As a result of the magnetic action of force, the armature 81 is moved upward. Here, a counterforce is exerted by the return spring 140. Since the movable shaft 40 is fixedly connected to the armature 81 by means of the pin 180, the movable shaft 40 is also raised with the movement of the armature 81 until the movable contact bridge 30 comes into contact with the fixed contact element 10 and the fixed contact element 20 if the movable shaft 40 has been moved to the first position. As a result, the switching device 1 is closed.

If the voltage supply is isolated from the winding of the coil body 130 and the magnetic field in the magnetic drive 80 is switched off, the shaft 40 and thus the movable contact bridge 30 move downward again as a result of the action of force of the return spring 140 and open the switching device 1.

In order to set a distance between the contact bridge 30 and the two fixed contact elements 10, 20, the switching device 1 has a setting device 50. The setting device 50 is arranged at the upper end E40*a* of the shaft 40. The setting device 50 is embodied in such a way that the distance between the contact bridge 30 and the first and the second contact element 10, 20 in a first position of the setting device 50 is less than in a second position of the setting device 50. The contact spring 60 is thus compressed more in the second position of the setting device 50 than in the first position of the setting device 50.

The shaft 40 can have a thread 41 at the upper end E40*a*. The setting device 50 is arranged on the thread 41. In particular, the setting device 50 in the second position is screwed further in the thread 41 than in the first position. The contact bridge 30 has a hole 33 through which the shaft 40 extends. At least part of the thread 41 of the shaft 40 projects out the hole 33 of the contact bridge on the upper side O30 of the contact bridge 30. The setting device 50 is arranged at least on that part of the thread 41 which projects out of the hole 33 of the contact bridge on the upper side O30 of the contact bridge 30.

The switching device 1 can have a covering element 70 for covering the setting device 50 and that part of the thread 41 which projects out of the hole 33 of the contact bridge 30 on the upper side O30 of the contact bridge 30. Such a covering element 70 makes it possible to avoid a voltage flashover between the fixed contact elements 10, 20 via the setting device 50 and/or the shaft 40. Furthermore, as is indicated in FIG. 2, the switching device 1 can have a sleeve which is plugged on the upper end E40*a* of the shaft and projects through the hole 33 of the contact bridge 30. The sleeve can have a bearing plate which bears on the upper side O30 of the contact bridge 30 and on which the covering element 70 is arranged.

According to one possible embodiment of the switching device 1, the setting device 50 can be embodied as a nut or adjusting nut 51 which is arranged on the thread 41. According to this embodiment, the distance between the upper side O30 of the contact bridge 30 and the first and the second contact elements 10, 20 is dependent on how far the nut 51 is screwed into the thread 41. The further the nut 51 is screwed downward in the direction of the end E40*b* of the shaft 40 into the thread 41, the greater the distance between the contact bridge 30 and the fixed contact elements 10, 20. If the nut 51 in the second position is screwed deeper, that is to say further downward in the direction of the end E40*b* of the shaft 40, into the thread 41 than in the first position, the distance between the contact bridge 30 and the first and second fixed contact element 10, 20 is greater than in the first position of the nut.

The further the nut 51 is screwed into the thread 41, the more the contact spring 60 is compressed. The action of force of the compressed contact spring 60 builds up a counterforce by means of which a stepless setting of the bridge position is possible. As a result, the distance between the fixed contact elements 10, 20, that is to say the main contacts, and the contact bridge 30 can be adjusted by means of the nut 51 arranged at the contact-proximate end E40*a* of the shaft 40.

The nut 51 has a larger diameter than the hole 33 of the contact bridge 30. As a result, the nut 51 can bear on the upper side O30 of the contact bridge 30. Alternatively or additionally, a washer 52 can be provided between the nut 51 and the upper side O30 of the contact bridge 30. Furthermore, as is indicated in FIG. 2, an above-described sleeve having a bearing plate can be present, with the shaft 40 and in particular a part of the thread 41 of the shaft 40 projecting through the sleeve. The nut 51 can have a diameter which is at least larger than an inside diameter of the sleeve. Alternatively or additionally, a washer can be provided between the nut 51 and the bearing plate of the sleeve.

According to a further possible embodiment, the shaft 40 can have at its upper end E40*a* a bore with an internal thread. An adjusting screw as setting device 50 can be screwed in the internal thread. The head of the adjusting screw preferably has a larger diameter than the hole 33. In this possible embodiment, the distance between the contact bridge 30 and the fixed contact elements 10 and 20 can be adjusted in dependence on how far the setting screw is screwed into the internal thread at the end E40*a* of the shaft 40.

In order to prevent a situation in which the distance between the contact bridge 30 and the fixed contact elements 10 and 20 changes again after the adjustment during operation of the switching device 1, the setting device 50 can be locked on the thread 41. The setting device 50 can be locked for example by an adhesive application between the thread 41 and the setting device 50 or by a weld between the setting device 50 and the thread 41. Another possibility of locking consists in deforming the thread 41 after the adjustment such that the setting device 50 can no longer be rotated.

Unlike the provision of a setting device at the lower end E40*b* of the shaft 40 and locking of the setting device between the shaft 40 and the armature 81 of the magnetic circuit, the described embodiments of the switching device 1 in which the setting device 50 is arranged at the upper, contact-proximate end E40*a* of the shaft 40 allow an adjustment of the contact bridge 30 with respect to the fixed contact elements 10, 20 even when a pot 190 of the switching device 1 has already been fixedly connected to the yoke 82 before the envelope of the switching chamber 100 has been fastened to the yoke 82. In this case, the interior of the pot 190 is no longer freely accessible, with the result that an adjustment of the bridge position by means of a setting device which would be arranged at the lower end E40*b* of the shaft is no longer possible.

Figure 3A:
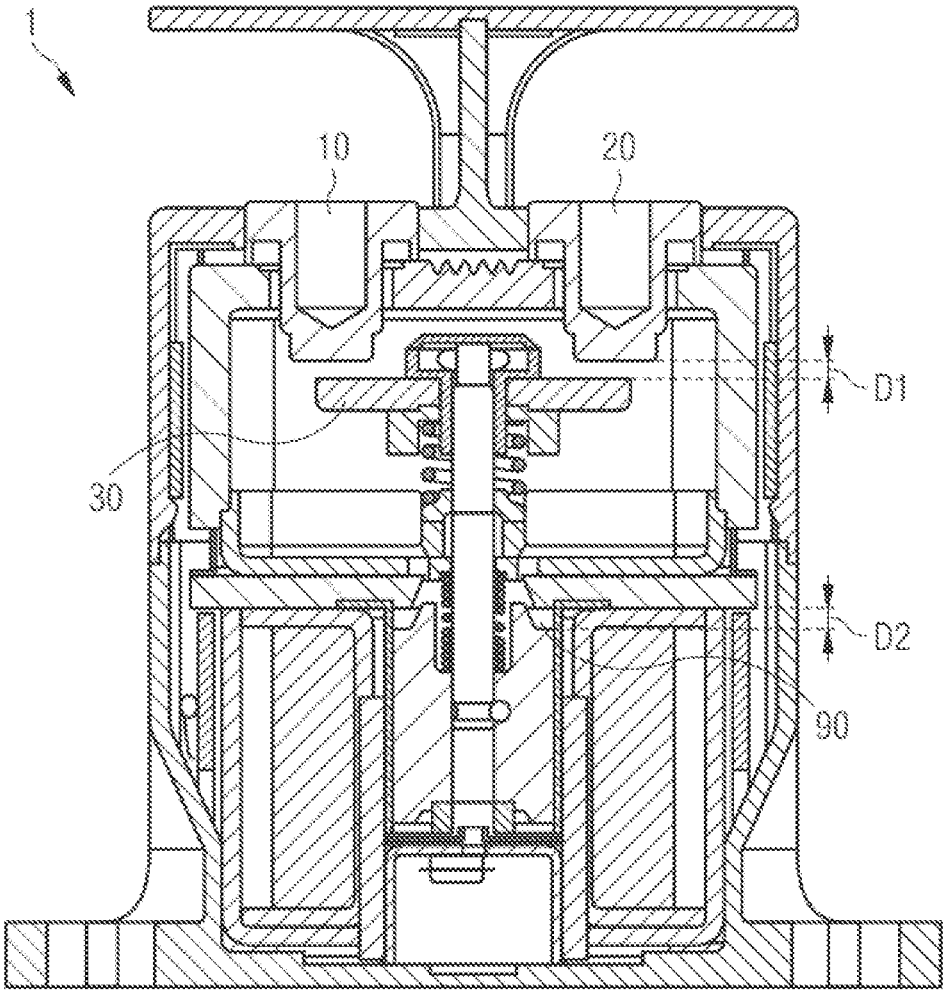
FIG. 3A shows a schematic illustration of a switching device for switching an electrical load with a first distance between a movable contact bridge and fixed contact elements of the switching device according to a further exemplary embodiment.
Figure 3B:
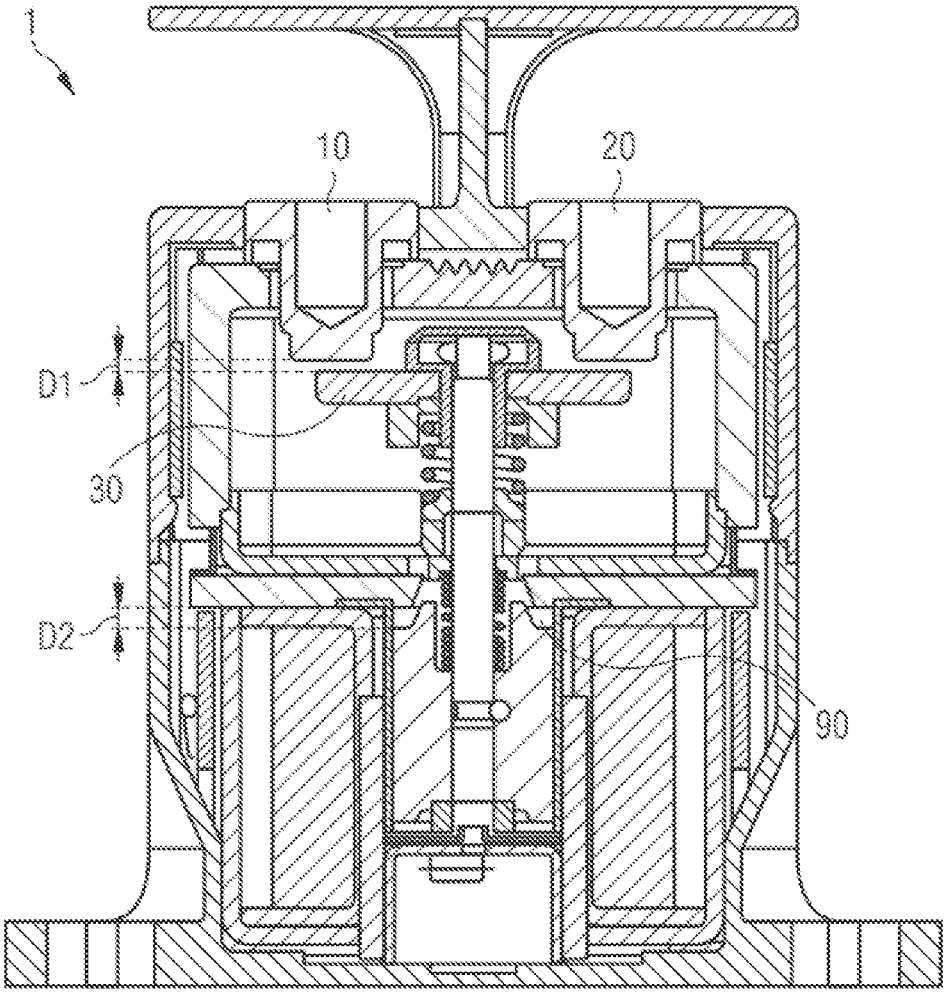
FIG. 3B shows a schematic illustration of a switching device for switching an electrical load with a second distance between a movable contact bridge and fixed contact elements of the switching device according to a further exemplary embodiment.

FIGS. 3A and 3B each show a cross section through the switching device 1 with the setting device 50 at the upper end E40*a* of the shaft 40. As can be seen from FIGS. 3A and 3B, the distance D1 between the main contacts 10 and 20 and the contact bridge 30 is directly linked with the screwing-in depth of the setting device 50, for example of the nut 51 on the thread 41. In the embodiment shown in FIG. 3A, the nut 51 is screwed deeper into the thread 41 than in the embodiment shown in FIG. 3B. Consequently, the distance D1 between the contact bridge 30 and the fixed contact elements 10, 20 in the position of the setting device 50 that is shown in FIG. 3A is greater than in the position of the setting device 50 that is shown in FIG. 3B.

The armature 81 and the yoke 82 are arranged so as to be spaced apart from one another by an air gap 90 at the first position of the contact bridge 30. The size of the air gap 90 is independent of whether the setting device 50 is situated in the first or second position. It becomes clear from FIGS. 3A and 3B that a length D2 of the magnetic gap 90, that is to say the length of the air gap 90 of the magnetic circuit, between the armature 81 and the yoke 82 is not influenced by the position of the setting device 50. In the case of the switching device 1 described, it is thus possible to set the distance between the contact bridge 30 and the contact elements 10, 20 without the length D2 of the magnetic gap 90 being changed thereby.

Figure 4A:
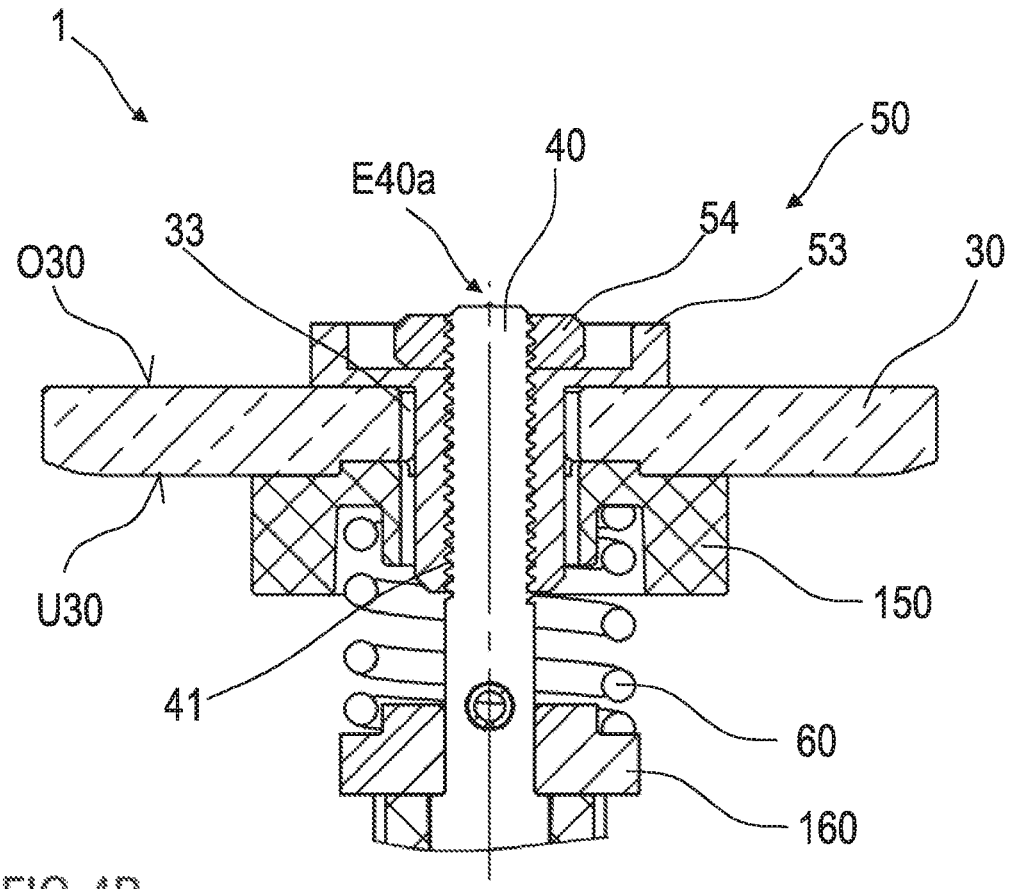
FIGS. 4A and 4B show a schematic illustration of a detail of a switching device and of a setting element of the switching device according to a further exemplary embodiment.
Figure 4B:
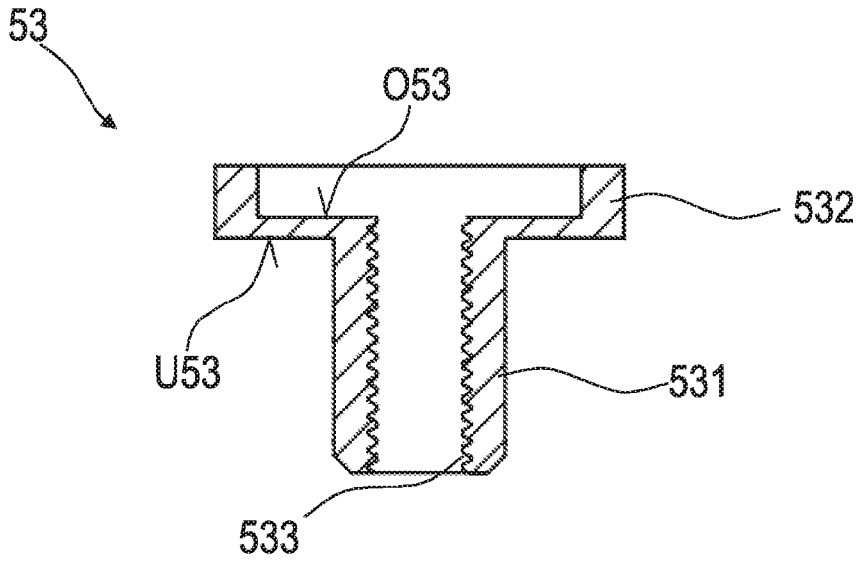

FIG. 4A shows a detail of a switching device 1 according to a further exemplary embodiment, which is a modification of the switching device of the preceding exemplary embodiments. FIG. 4B shows a setting element 53 of this switching device 1. The following description refers equally to FIGS. 4A and 4B and in this connection mainly to the differences over the preceding exemplary embodiments, with it being the case that features and functionalities of the switching device and components thereof that are not explicitly described below can be formed as described above.

FIG. 4A shows in particular, in a detail of the switching device 1, the upper end E40*a* of the shaft 40 with the movable contact bridge 30 and a setting device 50. The setting device 50 has, by comparison with the preceding exemplary embodiments, a setting element 53 which can be screwed onto the thread 41 of the shaft 40. In particular, the setting element 53 has a cylinder part 531, a bearing part 532 and a through-opening with an internal thread 533. The cylinder part 531 is embodied with the internal thread 533 in the form of a screw sleeve which is adjoined by the bearing part 532. In particular, the bearing part 532 projects laterally beyond the cylinder part 531 and thus forms a sleeve head through which the through-opening with the internal thread 533 extends.

The setting element 53 is pushed with the cylinder part 531 through the hole 33 of the contact bridge 30, with the cylinder part 531 having an outside diameter which is adapted to the diameter of the hole 33. This can mean that the outside diameter of the cylinder part 531 substantially corresponds to the diameter of the hole 33 or, as shown, is somewhat smaller, with the result that the contact bridge 30, on account of the resultant play, can be displaceable along the cylinder part 531 and/or tiltable. The setting element 53 thus projects with the cylinder part 531 from the upper side O30 of the contact bridge 30 in the direction of the magnetic drive of the switching device into the hole 33 and, preferably as shown, through the hole 33 and can in particular, as is shown in FIG. 4A, project further downward beyond the underside U30 of the contact bridge 30. The cylinder part 531 can thus be partially surrounded by the contact spring 60 that is to say in other words project into the region of the contact spring 60. In a corresponding manner to the hole 33 of the contact bridge 30 it is also possible for the upper bearing element 150 to have a hole into which the cylinder part 531 at least projects or preferably, as shown, through which the cylinder part 531 projects.

The bearing part 532 has an underside U53 facing the upper side O30 of the contact bridge 30 and bears in particular with the underside U53 on the upper side O30. The underside U53 of the bearing part 532 can be embodied in particular to correspond to the shape of the upper side O30 of the contact bridge 30 and can preferably bear against the upper side O30 in a form-fitting manner. In particular, the upper side O30 and the underside U53 can be of planar design. The height of the setting element 53 relative to the shaft 40 can be adjusted by screwing in the setting element 53 on the thread 41, that is to say by screwing the shaft 40 into the setting element 53 or by screwing the setting element 53 onto the thread 41 of the shaft 40. By virtue of the bearing part 532 bearing on the contact bridge 30 it is thus possible to set the maximum possible height of the contact bridge 30 along the shaft 40 in the direction of the upper end E40*a*. In a manner corresponding to the previous exemplary embodiments, the height of the contact bridge 30 relative to the upper end E40*a* of the shaft 40 can thus be set.

To lock the setting element 53 on the shaft 40, use can be made of one of the measures described in conjunction with the preceding exemplary embodiments. With particular preference, as is shown in FIG. 4A, a locknut 54 can be screwed onto the thread 41 of the shaft 40, said locknut pressing against an upper side O53 opposite the underside U53 such that the position of the setting element 53 can be locked. In addition, a washer can be present between the locknut 54 and the upper side O53. The upper side O53 can be of planar design particularly at least in the region in which the locknut 54 or a washer is in contact with the bearing part 532. For example, the entire upper side O53 can also be of planar design, with the result that the bearing part 532 can be formed as a plate. With particular preference, as shown in FIGS. 4A and 4B, the upper side O53 can have a depression which can preferably have at least substantially a depth which corresponds to a thickness of the nut 51 or a thickness of the nut 51 and of an additional washer.

As is described in conjunction with FIG. 2, a covering element, which is not shown for the sake of clarity, can be present over the setting device 50. In particular, the covering element can be arranged on the bearing part 532 of the setting element 53.

With particular preference, the setting element 53 comprises or consists of an electrically insulating material. The electrically insulating material can for example comprise or consist of a plastics material such as for instance glass-filled polybutylene terephthalate (PBT), nylon and/or polyoxymethylene. Furthermore, the electrically insulating material can also comprise or be a ceramic material, such as for example aluminum oxide. Moreover, electrically insulating composite materials are also possible. By virtue of the fact that the setting element 53 can comprise or consist of an electrically insulating material, electrical insulation between the shaft 40 and the contact bridge 30 can be achieved. If, as described above, the bearing part 532 has a depression on the upper side O53, the probability of leakage currents can be reduced. Furthermore, in the exemplary embodiment of FIGS. 4A and 4B and also in the preceding exemplary embodiments, the upper and/or lower bearing element 150, 160 can comprise or consist of an electrically insulating material, in particular an aforementioned electrically insulating material.

The setting element 53 thus allows not only an adjustment of the height of the contact bridge 30 relative to the shaft 40 and thus relative to the fixed contacts 10, 20 but also serves for electrical insulation between the contact bridge 30 and the shaft 40. It is thus possible for additional electrically insulating parts customarily used in the prior art to be avoided and for the component complexity to be reduced.

The exemplary embodiments and features described in conjunction with the figures can be combined with one another according to further exemplary embodiments even if such combinations are not explicitly described. Furthermore, the exemplary embodiments described in conjunction with the figures can have alternative or further features according to the description in the general part.

The invention claimed is:

1. A switching device comprising:

a first fixed contact element;

a second fixed contact element;

a movable contact bridge;

a movable shaft configured to move the contact bridge, wherein the shaft is movable to a first position at which the contact bridge contacts the first and second contact elements, and wherein the shaft is movable to a second position at which the contact bridge is arranged at a distance from the first and second contact elements; and a setting device configured to set the distance between the contact bridge and the first and second contact elements in the second position, wherein the contact bridge and the setting device are arranged at a first end of the shaft, wherein the shaft has a second end opposite the first end, wherein an upper side of the contact bridge faces away from the second end of the shaft, wherein the shaft has a thread at the first end, wherein the setting device is arranged on the thread, wherein the setting device has a setting element which bears with a bearing part on the upper side of the contact bridge and projects with a cylinder part through a hole, and wherein the switching device is configured to switch an electrical load.

2. The switching device according to claim 1, wherein the setting element has an internal thread with which the setting element is screwed on the thread of the shaft.

3. The switching device according to claim 1, wherein the setting element comprises an electrically insulating material.

4. The switching device according to claim 1, wherein the setting device is embodied as a nut arranged on the thread, wherein the distance between the upper side of the contact bridge and the first and second contact elements is dependent on how far the nut is screwed into the thread.

5. The switching device according to claim 4, wherein the nut or a washer, which is arranged between the nut and the contact bridge, bears on the upper side of the contact bridge.

6. The switching device according to claim 1, wherein the setting device is locked on the thread.

7. The switching device according to claim 6, wherein the setting device is locked by an adhesive on the thread or by a weld on the thread or by a deformation of the thread or by a locknut on the thread.

8. The switching device according to claim 1, further comprising a covering element configured to cover the setting device and a part of the thread which projects out of the hole of the contact bridge on the upper side of the contact bridge.

9. The switching device according to claim 1, further comprising:

a magnetic drive configured to move the contact bridge between the first and second positions, wherein the magnetic drive has an armature and a yoke, wherein the armature and the yoke, at the first position of the contact bridge, are arranged so as to be spaced apart from one another by an air gap, and wherein a size of the air gap is dependent on whether the setting device is situated in the first or second position.

10. The switching device according to claim 1, wherein the switching device is embodied as a contactor or a relay.

11. A switching device comprising:

a first fixed contact element;

a second fixed contact element;

a movable contact bridge;

a movable shaft configured to move the contact bridge, wherein the contact bridge is arranged at an end of the shaft, wherein the shaft is movable to a first position at which the contact bridge contacts the first and second contact elements, and wherein the shaft is movable to a second position at which the contact bridge is arranged at a distance from the first and second contact elements; and a setting device configured to set the distance between the contact bridge and the first and second contact elements in the second position, wherein the setting device is arranged at the end of the shaft, wherein the shaft has a thread at the end, and wherein the setting device is arranged on the thread, wherein the distance between the contact bridge and the first and second contact elements, in the first position of the setting device, is less than in the second position of the setting device, wherein the setting device, in the second position, is screwed in further on the thread than in the first position, and wherein the switching device is configured to switch an electrical load.

12. A switching device comprising:

a first fixed contact element;

a second fixed contact element;

a movable contact bridge;

a movable shaft configured to move the contact bridge, wherein the contact bridge is arranged at an end of the shaft, wherein the shaft is movable to a first position at which the contact bridge contacts the first and second contact elements, and wherein the shaft is movable to a second position at which the contact bridge is arranged at a distance from the first and second contact elements; and a setting device configured to set the distance between the contact bridge and the first and second contact elements in the second position, wherein the setting device is arranged at the end of the shaft, wherein the shaft has a thread at the end, wherein the setting device is arranged on the thread, wherein the contact bridge has a hole through which the shaft extends, wherein at least part of the thread of the shaft projects out of the hole of the contact bridge on an upper side of the contact bridge, and wherein the switching device is configured to switch an electrical load.

13. The switching device according to claim 12, wherein the setting device is arranged at least on a part of the thread which projects out of the hole of the contact bridge on the upper side of the contact bridge.

14. The switching device according to claim 12, further comprising:

a magnetic drive configured to move the contact bridge between the first and second positions, wherein the magnetic drive has an armature and a yoke, wherein the armature and the yoke, at the first position of the contact bridge, are arranged so as to be spaced apart from one another by an air gap, and wherein a size of the air gap is dependent on whether the setting device is situated in the first or second position.

15. The switching device according to claim 12, wherein the switching device is a contactor or a relay.

16. The switching device according to claim 11, further comprising:

a magnetic drive configured to move the contact bridge between the first and second positions, wherein the magnetic drive has an armature and a yoke, wherein the armature and the yoke, at the first position of the contact bridge, are arranged so as to be spaced apart from one another by an air gap, and wherein a size of the air gap is dependent on whether the setting device is situated in the first or second position.

17. The switching device according to claim 11, wherein the switching device is embodied as a contactor or a relay.

* * * * *